United States Patent [19]

Erhardt

[11] 4,178,847

[45] Dec. 18, 1979

[54] ITEM ENDORSING APPARATUS

[75] Inventor: Heinrich S. Erhardt, Warminster, Pa.

[73] Assignee: Burroughs Corporation, Detroit, Mich.

[21] Appl. No.: 833,298

[22] Filed: Sep. 14, 1977

[51] Int. Cl.[2] ..... B41L 47/46

[52] U.S. Cl. ..... 101/91; 101/235

[58] Field of Search ..... 101/232-235, 101/245, 91, 92, 72, 109, 377, 381

[56] References Cited

U.S. PATENT DOCUMENTS

| | | | |
|---|---|---|---|
| 2,636,436 | 4/1953 | Mann | 101/235 |
| 2,723,621 | 11/1955 | Payne | 101/377 |
| 2,743,671 | 5/1956 | Weber et al. | 101/235 |
| 3,037,447 | 6/1962 | Gonzalez et al. | 101/235 X |
| 3,537,393 | 11/1970 | Hegi | 101/235 |
| 3,641,933 | 2/1972 | Tafel | 101/181 |
| 3,734,011 | 5/1973 | Williams | 101/235 X |
| 3,791,294 | 2/1974 | Skelding et al. | 101/181 X |
| 3,815,497 | 6/1974 | Wallace | 101/91 X |
| 4,023,489 | 5/1977 | Beery | 101/235 X |
| 4,036,127 | 7/1977 | Speicher | 101/245 X |

*Primary Examiner*—Edward M. Coven
*Attorney, Agent, or Firm*—Carl Fissell, Jr.; Kevin R. Peterson

[57] ABSTRACT

High speed printing endorsing apparatus of modular construction capable of automatically printing both fixed and variable information simultaneously upon items fed to said apparatus in a continuous uninterrupted stream of items. Differential gearing and a wrap spring clutch in combination with a cam and follower concentric with the main drive shaft of the apparatus provide means for automatic item batch consecutive number advance by means of relative motion between the cam the printing apparatus. The item batch printing device is demountably removable permitting alteration of the fixed information while the vertical position of the batch printing relative to the item information field format is alterable at will. Automatic means is provided for loading and unloading the print head inking assembly against the print head so as to avoid any bleeding of the inking mechanism when not in use. Automatic means is provided for exposing the print head in the "ready for print" position and for retracting the print head to a "store" position. Simultaneously a shield is automatically placed across the opening in the document track when the print head is retracted to said "store" position. The shield is automatically removed from the opening in the document track to be occupied by the print head in the "ready for print" position.

10 Claims, 13 Drawing Figures

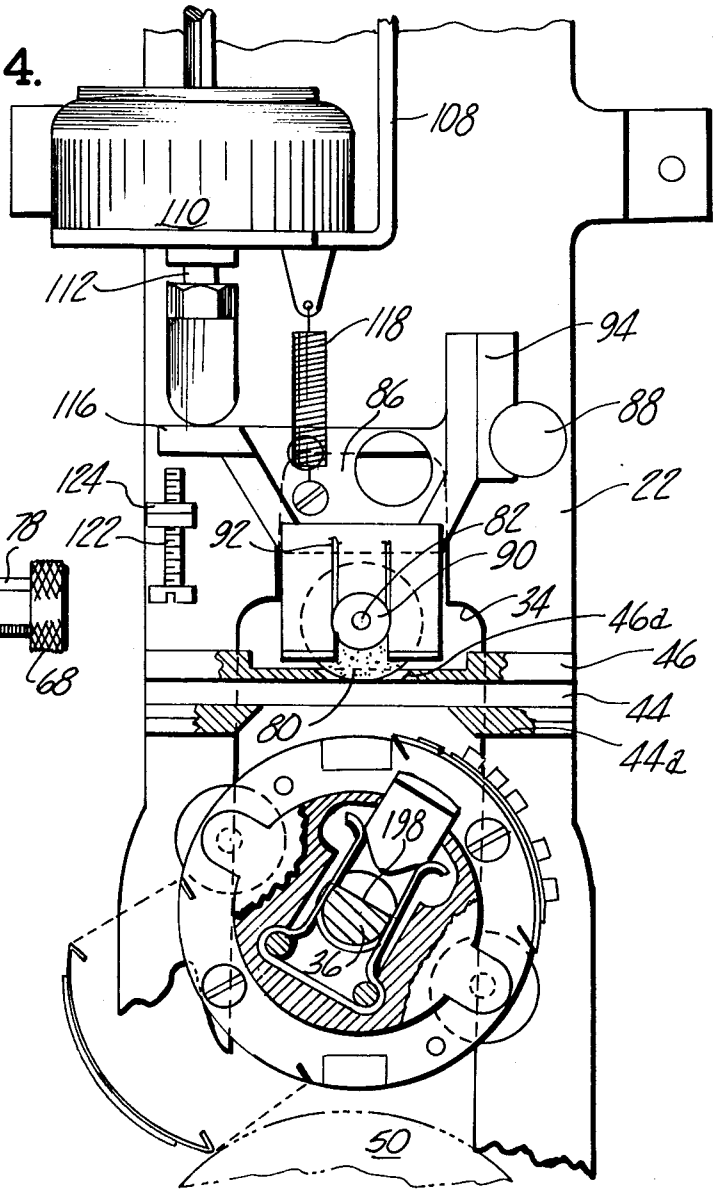
FIG. 4.
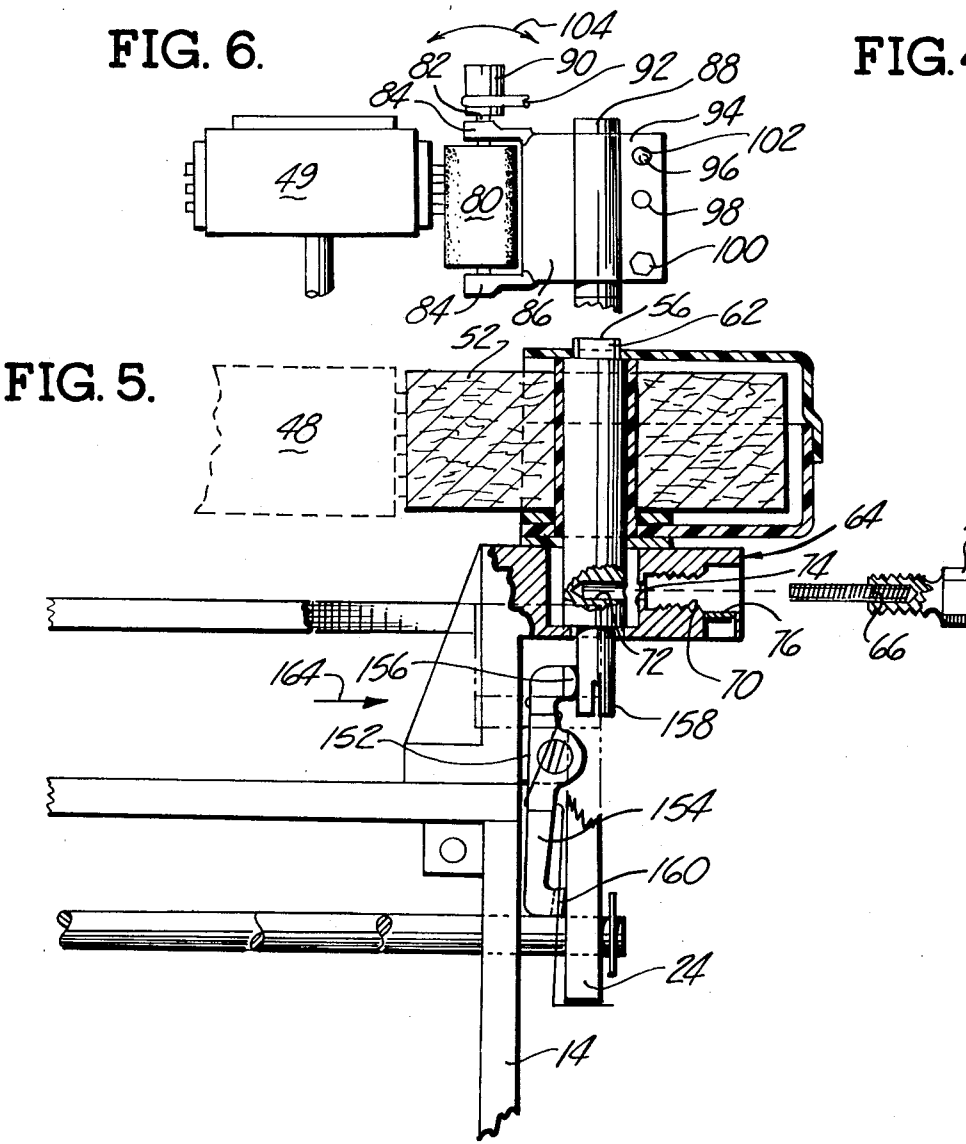
FIG. 6.
FIG. 5.

8A
8A
RLS
RLS

ITEM ENDORSING APPARATUS

BACKGROUND OF THE INVENTION

The present invention is directed to the field of printing and more particularly to the field of printing endorsements on items or documents such, for example, as bank checks.

This field of art is replete with a variety of apparatus and mechanisms for cyclically printing data on items such as bank checks. These prior art printer-endorsers all have certain limitations; for example, low speed, or inaccessible operating parts making repair and maintenance quite difficult. Also, many of these types of apparatus are not automatic in operation but rather require operator intervention to change both fixed as well as other data which is to be printed thereby. They also usually require manual intervention to activate or deactivate.

Those types of apparatus that are capable of high speed printing are limited severely by the reliability of the variable information device, i.e. batch number device, since the change in the variable information is always done at very high speeds.

SUMMARY OF THE INVENTION

An important object of the invention is to provide a completely modular, demountable, replaceable printer-endorser for item sorting apparatus.

Another important object of the invention is to provide a modular item endorser which is completely automatic in operation thus avoiding the requirement for continued operator intervention.

Still a further object of the invention is to provide a printer-endorser for item documents such as checks wherein the print head is readily accessible to the operator and is easily demountable for change or alteration of the fixed data carried thereby.

Another object of the invention is the provision of automatic batch advance numbering of the items being endorsed by such apparatus.

These and other objects and advantages of the present invention are provided by high speed endorsing apparatus of modular construction capable of automatically printing both fixed and variable information simultaneously upon items fed to said apparatus in a continuous uninterrupted stream of items. Differential gearing and a wrap spring clutch in combination with a cam and follower concentric with the main drive shaft of the apparatus provide automatic item batch consecutive number advance by providing relative motion between the cam and the printing apparatus. The relative velocity between the cam and the printing apparatus can be maintained at a desired magnitude by altering certain gear ratios, irrespective of the absolute velocity of the print head. Thus the endorsing apparatus has potential for application over a wide range of document speeds. The item batch printing device is demountably removable permitting alternation of the fixed information while the bath printing location relative to the item information field format is alterable at will. Automatic means is provided for loading and unloading the print head inking assembly against the print head so as to avoid any bleeding of the inking mechanism when not in use. Automatic means is provided for advancing the printing apparatus to the "ready for print" position and for retracting to the "store" position, all upon operator demand. The document track is automatically adjusted for the presence or absence of the print head by means of a shield.

The above stated objects, advantages and other aspects of the invention will be fully explained in the following detailed description. For a more complete understanding of the invention reference may be had to the following detailed description in conjunction with the drawings and claims.

BRIEF DESCRIPTION OF THE DRAWINGS

FIG. 4 is a partial top plan view, not drawn to scale, of the demountable print head assembly and the mechanism associated therewith for printing on the item;

FIG. 5 is an enlarged detail view, partially in section, of the inking assembly and the mechanism for preloading this assembly against the print head;

FIG. 6 is a detail view of the print head and platen roller assembly illustrating the mechanism for maintaining these assemblies parallel;

DESCRIPTION OF THE PREFERRED EMBODIMENT OF THE INVENTION

The present invention is a modular, demountable, automatic endorser-printer for use with business items or documents such, for example, as checks, bills of exchange and the like which daily pass through banks and clearing houses and which must be numbered, dated and "batch" counted. Batch counting is simply the enumeration of a particular group or groups of items or "batches" which may have the same or similar day, date, month, notation or some similar repeating data or information thereon.

In order to avoid operator intervention, especially, although not exclusively, in the changing of batch numbers, the present invention provides a novel, demountable means enabling the operator to "set and forget" the fixed information while the variable information is automatically updated chronologically as the items are fed past the printer-endorser mechanism. Also provided by the present invention is automatic means for engaging and disengaging the printer-endorser from the printing anvil so as to induce or prevent endorsement on demand. The present apparatus thus is able to place a printed endorsement on documents in one of a number of available locations on the document. The imprinted legend contains both fixed and variable information. The fixed information is provided by suitable dies of rubber or similar material. The variable information, e.g. four digit number, is provided by an automatic numbering device.

Figure 1:
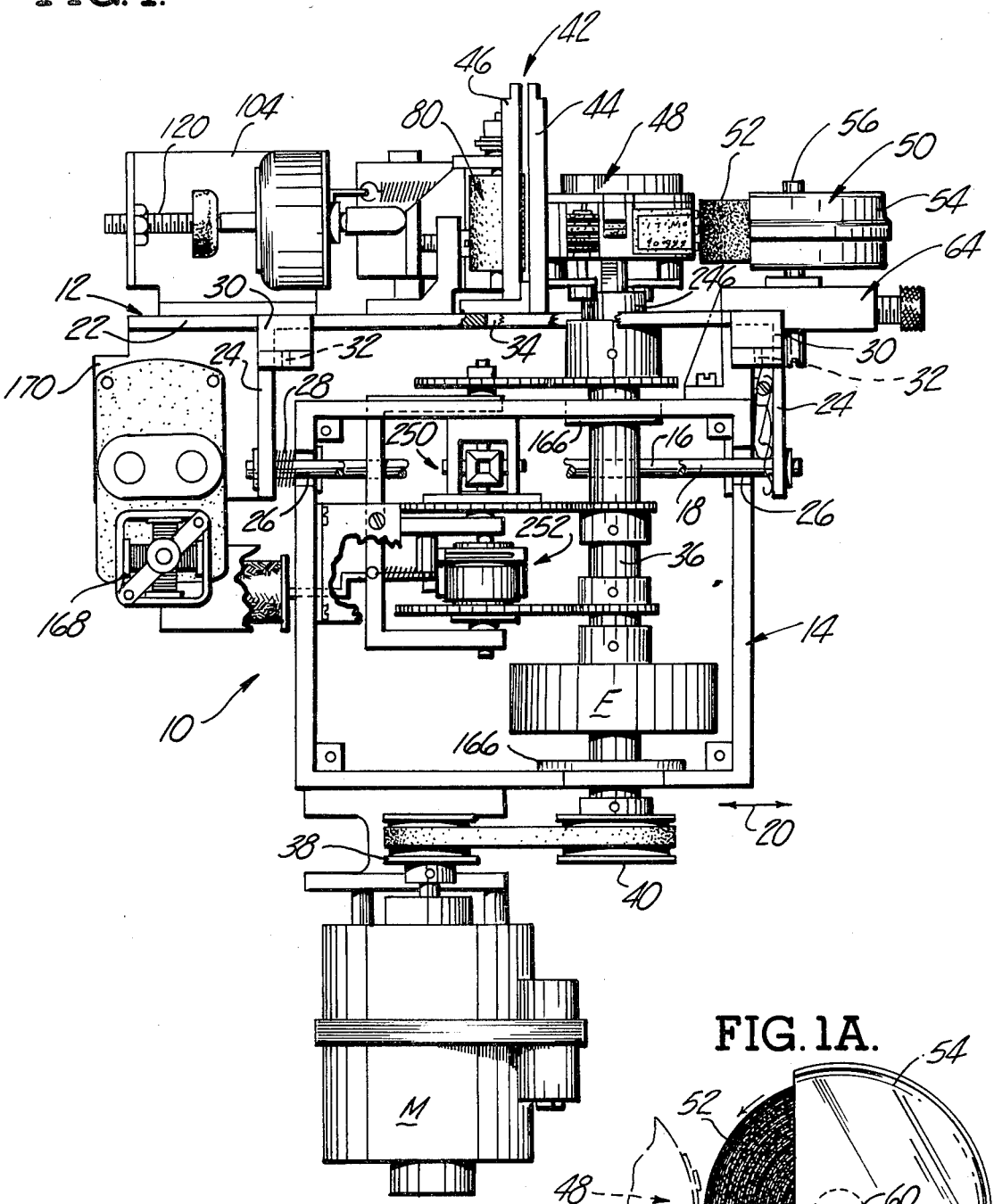
FIG. 1 is a side elevational view of an item endorsing-printing mechanism embodying the present invention illustrated as a modular assembly for mounting in an item sorter.

As viewed in FIG. 1 of the drawings, the modular automatic endorser-printer 10 comprises two independent, rigid, frame assemblies; an upper frame assembly 12 and a lower frame assembly 14, respectively. Frame assembly 12 is operably coupled to frame assembly 14, upon which it is supported, by means of two substantially horizontal, rigid, rods 16 and 18 providing front and rear sliding supports permitting lower frame assembly 14 to be slidably movable left and right in the direction of arrow 20, as viewed in FIG. 1, relative to upper support assembly 12. These two assemblies may be fabricated from rigid metal or stiff plastic material having sufficient rigidity for the application.

Upper frame assembly 12 includes an elongate, flat, rigid, plate-like base member 22 provided with depending, rigid U-shaped bearing end support members 24—24 at opposite ends thereof, FIGS. 1, 2, 8, 10 and 11, formed, brazed, welded or otherwise secured thereto. Rods 16 and 18 are journaled at opposite ends in lower support 14 by means of bearings 26 through which the rods are passed. The rods are retained at each end by means of associated C-rings. Springs 28 at one end of each rod 16 and 18, respectively, bias the frame 14 in one direction and also act as stops and/or shock absorbers as the frame moves from side to side, as viewed in FIG. 1. They also act as return springs for frame 14.

The bias provided by the springs maintains a constant distance between the print head and the platen when assembly 14 is positioned to the left, as described in FIG. 1. This happens because the free play between the cam 174 and the follower 178 is all removed in one direction due to the spring loads. (See FIG. 8)

Oppositely disposed L-shaped brackets 30, welded, brazed or otherwise secured to the plate 22 and drilled as at 32, act as mounting supports for the apparatus and permit the latter to be mounted on or in the associated item sorter apparatus from which the endorsing apparatus can be easily, quickly and efficiently dismounted. Bolts, not shown, effectively tie the modular assembly in place in the associated sorter apparatus.

The upper frame assembly 12 includes an enlarged, substantially central cutout or opening 34, FIG. 4, into and through which main driving shaft 36 vertically projects, for purposes to be explained presently. Output drive shaft 36 is rotated by means of an electric motor M, the output shaft 37 (acting as an input means to drive shaft 36) of which is coupled thereto, through a notched belt and pulleys 38 and 40. Flywheel F maintains a constant and uniform velocity of the shaft and associated parts.

Intermediate the ends of plate 22, (substantially in the middle thereof) is a throat or guideway 42 formed by two vertical, upstanding, rigid, wall forming members 44 and 46 extending from edge to edge of member 22, i.e. at right angles to the longer dimension thereof, and arranged so that when the modular assembly 10 is introduced within the item sorter with which it is or may be operably associated, the plates 44 and 46 will form a portion of a substantially continuous and uninterrupted item or document guideway through the apparatus.

Each of the wall forming members 44 and 46 are milled, drilled or otherwise perforated (as seen in FIG. 4) to provide a fairly large rectangular opening 44*a* and 46*a*, respectively, therethrough. Arranged to rotate with main drive shaft 36, adjacent to opening 44*a* and wall 44, is a rotatable, demountable print head 48. Wall member 44 is undercut adjacent to the perimeter of the print head 48 so that the periphery of print head 48 is adapted to project slightly into and through the opening 44*a* as the print head rotates for purposes which will become more apparent later on herein.

A demountable inking member 50, includes e.g. "Porelon" ® inking roller 52, manufactured by Johnson Wax Co., 1525 Howell St., Racine, Wisconsins 53403, enclosed in an ink shield 54, rotatably disposed adjacent to print head 48 on a rigid support shaft 56 with the rotatable inking roller 52 thereof in peripheral contact with the perimeter of the print head 48.

Shaft 56 is arranged to be slidably, adjustably, positionable, relative to mounting support 64, as seen most clearly in FIG. 5. An inking roller load force adjustment is provided for the print head 48 by means of a spring 66 supported at one end in the hollow threaded shank of knurled bolt 68 and extending within threaded aperture 70 in member 64 into a shallow opening 72 and shaft 56. An enlarged slotted recess 74 in frame or support 64 permits the vertically disposed shaft 56 to be moved horizontally therewithin by means of the knurled knob 68 so as to vary the gap between the perimeter of the inking roller 52 and the periphery of the print head 44 effectively controlling the load force of the ink roller against the print head 44. A flat spring 76, of steel or similar material rides against the flats 78 on bolts 68 restricting rotative movement of the bolt and retaining the preadjustment.

Figure 1A:
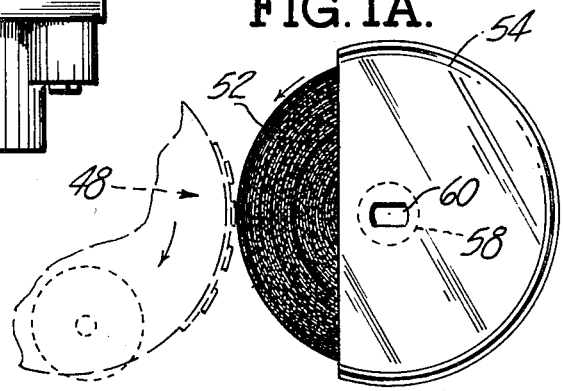
FIG. 1A is a top plan view of the inking roller and shield for the present invention.

Shield 54 (FIG. 1A) is provided with a lower circular opening 58 receivable over the circular portion of shaft 56 while the upper portion of shield 54 is provided with a rectangular cutout 60 matingly engageable with the rectangularly shaped end 62, FIG. 5, of shaft 56. This prevents the shield from rotating with the inking roller 52.

Figures 8, 9:
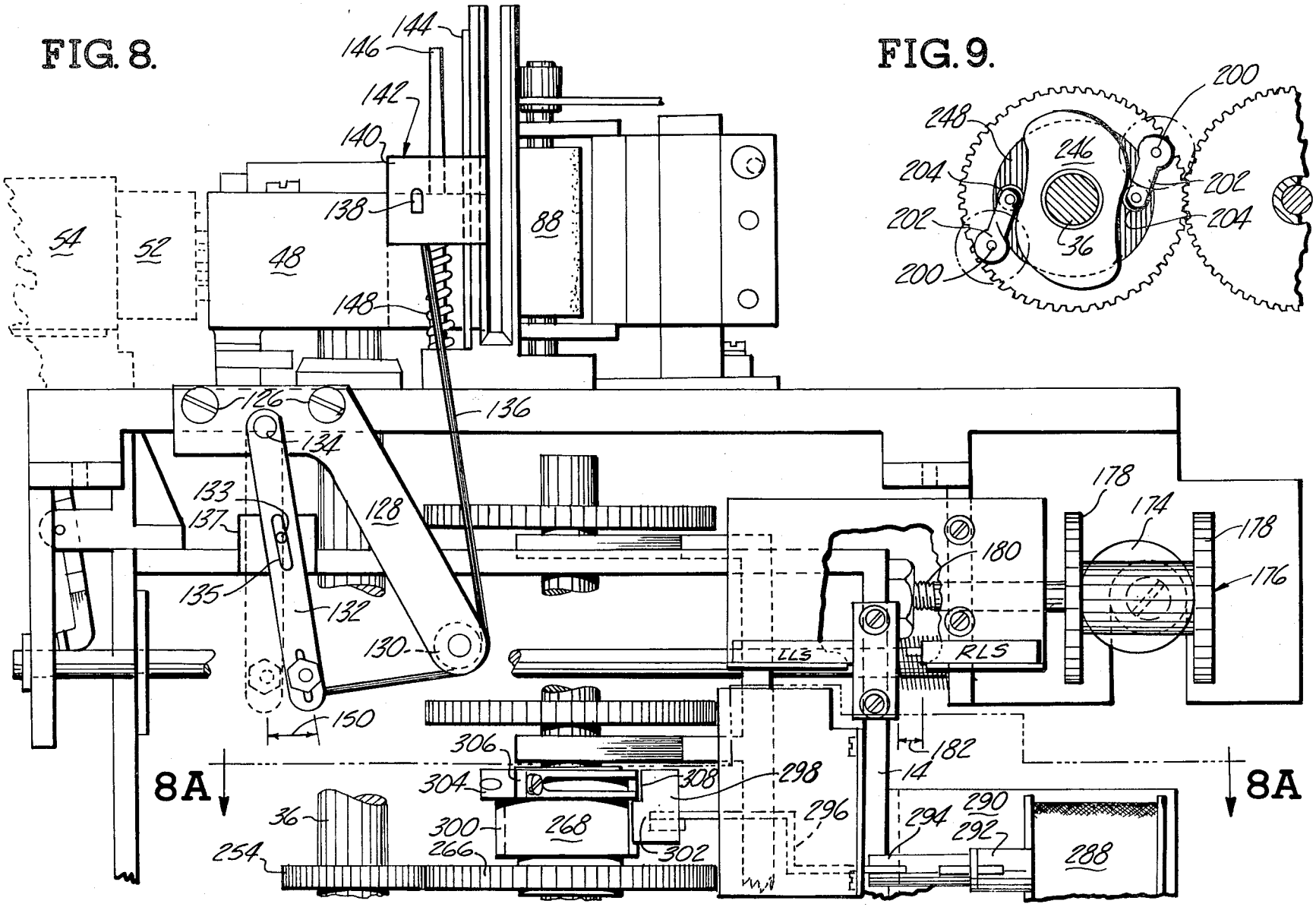
FIG. 8 is a side elevational view of a portion of the apparatus of FIG. 1 illustrating the adjustable shield mechanism and the cam mechanism for moving the print head into contact with the items.
FIG. 9 is a top plan view partially in section of the cam and follower for indexing the batch advance mechanism of the print head assembly.

Returning to FIG. 1, located adjacent to the opposite guideway wall forming member 46 is a vertically disposed, rotatable platen member 80, FIGS. 1, 4, 6 and 8, the periphery of which is adapted to extend through the opening 46*a* in wall 46 so as to contact the perimeter of the print head 44 when the print head is loaded thereagainst. Platen 80 is rotatably mounted by means of a vertical shaft 82 on the forwardly extending yoke arms 84 of L-shaped platen support member 86, the latter being rockably pivoted on a vertically disposed post 88 upstanding from plate 22. A grooved roller 90 on shaft 82 permits platen 80 to be driven by means of "O" ring drive 92 (FIGS. 4 and 6) from an adjacent document drive roller (not shown) so that print head peripheral speed, document speed and platen peripheral speed are synchronized.

Since the platen 80 and print head 48 must rotate against each other in a parallel relationship in order to precisely and accurately transfer the information from the print head to the face of the item or document being moved through the apparatus, means is provided for adjusting the parallelism between print head 48 and platen roller 80. Platen support member 86 includes a hinge-like portion 94, FIG. 6, surrounding post 88 and secured to member 86 by means of bolts 96, 98 and 100. An eccentric opening 102 in member 94 permits bolt 96 to axially tilt the platen 80 about the vertical axis as indicated by the arrow 104 effective to bring the platen 80 and print head 48 into parallelism.

Figure 3:
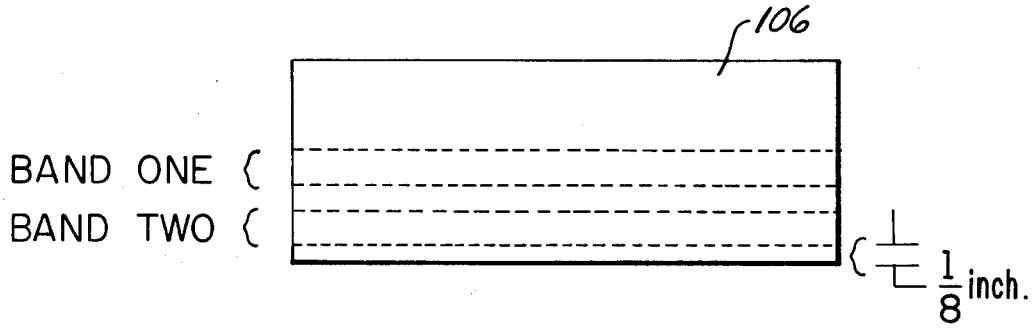
FIG. 3 is an enlarged detail view of a portion of an item illustrating two bands or areas of endorsement provided by the present invention.

Printing is accomplished by impacting the resilient covered platen 80 (e.g. rubber) against the print head 48 while simultaneously passing a document 106, FIG. 3, between platen and print head. Printing will occur only for the time the platen, document and print head are in intimate contact. The platen is brought to impact by means now to be described.

Disposed on the left end of plate 22, FIG. 4, is a U-shaped bracket 108 supporting a solenoid 110, the plunger 112 of which, is adapted to abut the end 114 of the forwardly turned wall 116 of support member 86. A return spring 118, attached at one end to member 86 and at its opposite end to a clip on bracket 108, maintains platen 80 in a retracted position away from print head 48 adjacent to the item guideway wall 46. Adjustment screw 120, FIG. 1, in the rear portion of bracket 108 limits the throw or travel of solenoid plunger 112. Adjustment screw 122 in upstanding post 124 limits the arcuate movement of the member 86 about post 88.

Apparatus embodying this invention includes a so-called print band option, FIG. 3, i.e. endorsement can be printed on items such as checks 106 in either of two vertical positions. Printing is accomplished in the area ⅛" above the bottom longer edge of each item or document and each band of printing is 0.640 inches in height. The endorser housing is mounted in one of two different positions relative to the mounting frame 22 so as to provide the upper "band one" or the lower "band two" position. As part of the band selection the document guide is altered at the time the apparatus is installed and a non-endorse shield arrangement is provided, as will now be described.

Since retraction of print head 48 from the area of the document guide wall member 44 leaves an open area in the guide wall, means is provided (as seen in FIG. 8) for shielding the opening i.e. closing the opening off, until such time as the print head 44 is actuated. Secured to plate 22 as by bolts 126 along one facing edge, FIG. 8, is an L-shaped bracket 128 carrying a small pulley wheel 150 at the depending end thereof. An arcuately movable link 132 pivoted at 134 to bracket 128 depends therefrom and has secured to the lower end thereof, a control line, e.g. wire cable 136. The opposite end of the control cable 136 is attached to a tab 138 on the outwardly projecting end 140 of a substantially L-shaped relatively thin, rigid, non-endorse shield member 142. Shield 142, which is carried by bracket 144, is slidably disposed on a vertical post 146 secured at its base to frame member 22 and disposed in upstanding relationship thereto. The inboard portion of shield 142 projects into the area between the outer periphery of platen wheel 88 and the print head 48. Spring 148 surrounding post 146 biases the shield upwardly from the dotted line "interfering" position into the full line "noninterfering" position exposing the opening 44a in wall member 46 permitting endorsement or printing as desired. Rocking movement of link 132 about pivot point 134 from the full line to the dotted line position arrow 150 drives shield 142 downwardly against the tension of spring 148 causing the shield to cover the opening in wall 46 effectively preventing endorsement or printing.

Operation (rotation) of link 132 is accomplished by a pin 133 riding in a slot 135 in link 128. The pin projects from a small plate 137 attached to movable frame assembly 14.

Means is provided for automatically unloading the ink roller 52 away from print head 48 when the endorser apparatus 10 is in the inoperative mode, i.e. turned "off". This, in effect, keeps the ink roll from bleeding when not in use. Pivotally mounted on a tab 152. FIGS. 1 and 5, projecting outwardly away from the lower end of support member 64, is a rockable lever 154. The irregularly bent upper end or tang portion 156 of of lever 154 is adapted to contact and ride against the depending portion 158 of ink roller bearing shaft 56. The opposite lower end of lever 154 is bent at right angles to the long dimension of the lever 154 forming a tang 160 which is adapted to ride against the facing portion of depending member 24, under the constant urging of a tension spring 162.

Movement of the endorser housing assembly 12 in the direction of arrow 20 by automatic means, still to be described herein, to disengage print head 48 (carried by housing 12) causes lever 154 to pivot about tab 152 since the lower portion and tang 160 is pressed against the facing portion of member 24. As the upper portion of link 154 moves rightwardly in the direction of arrow 164, the upper tang 156 moves against shaft end 158 in the same direction causing shaft 56 to move within the slotted support bracket 64. This movement unloads the ink roller 52 from print head 48.

Print head 48 is positionable horizontally, FIGS. 1 and 8, by drive means coupled to the upper and lower frame members 12 and 14, as will now be described. Main drive shaft 36 which is vertically mounted, as earlier mentioned herein, within ball bearings (not shown) in the frame 14 and is supported at its upper and lower ends in bearing blocks 166, FIGS. 1 and 2. The frame or housing 14 rides on two sets of horizontally disposed rails or rods 16 and 18, also earlier mentioned herein, which permits the frame 14 to be moved sideways with springs 28—28 acting to bias the frame in one direction and also acting as bumpers or shock absorbers for the frame as it terminates its sidewise movement. Springs 28 also bias any free play out of the positioning linkage.

Figure 11:
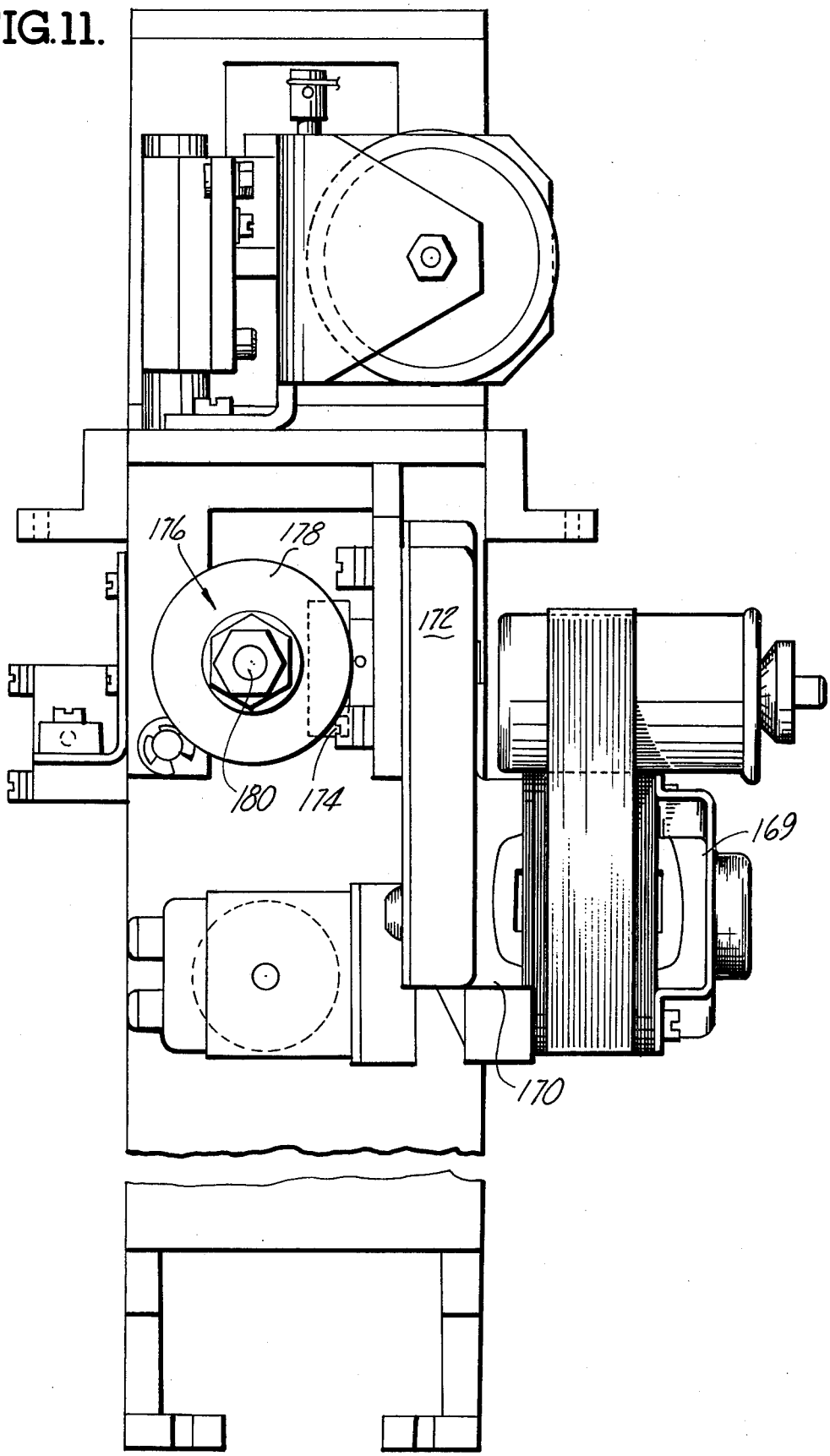
FIG. 11 is a partial end elevational view of the rear of the apparatus illustrating the cam shifting mechanism for moving the print head into the path of the item.

An electric motor 168, FIGS. 1 and 11, mounted on an outboard frame 170, the output shaft (not shown) of which is coupled to a step down gear drive 172, carries an eccentric cam 174, FIGS. 8 and 11, which is operably coupled to a spool-like follower member 176 with the cam disposed between the confronting rims 178 of the follower. Threaded shaft 180 threadedly secured to the sidewall of frame 14 supports follower 176 so that upon rotation of cam 174 by motor 168, follower 176 is caused to move from side to side moving the frame 14 in like manner, a slight distance as indicated by arrow 182. This sidewise movement places the print head 48 in position for impacting by the printing platen 80, as previously programmed or desired. Right and left limit switches RLS-LLS, respectively, are actuated by contact with the sidewall of frame 14 as it moves from right to left and back energizing or de-energizing the drive motor 168.

Figure 7:
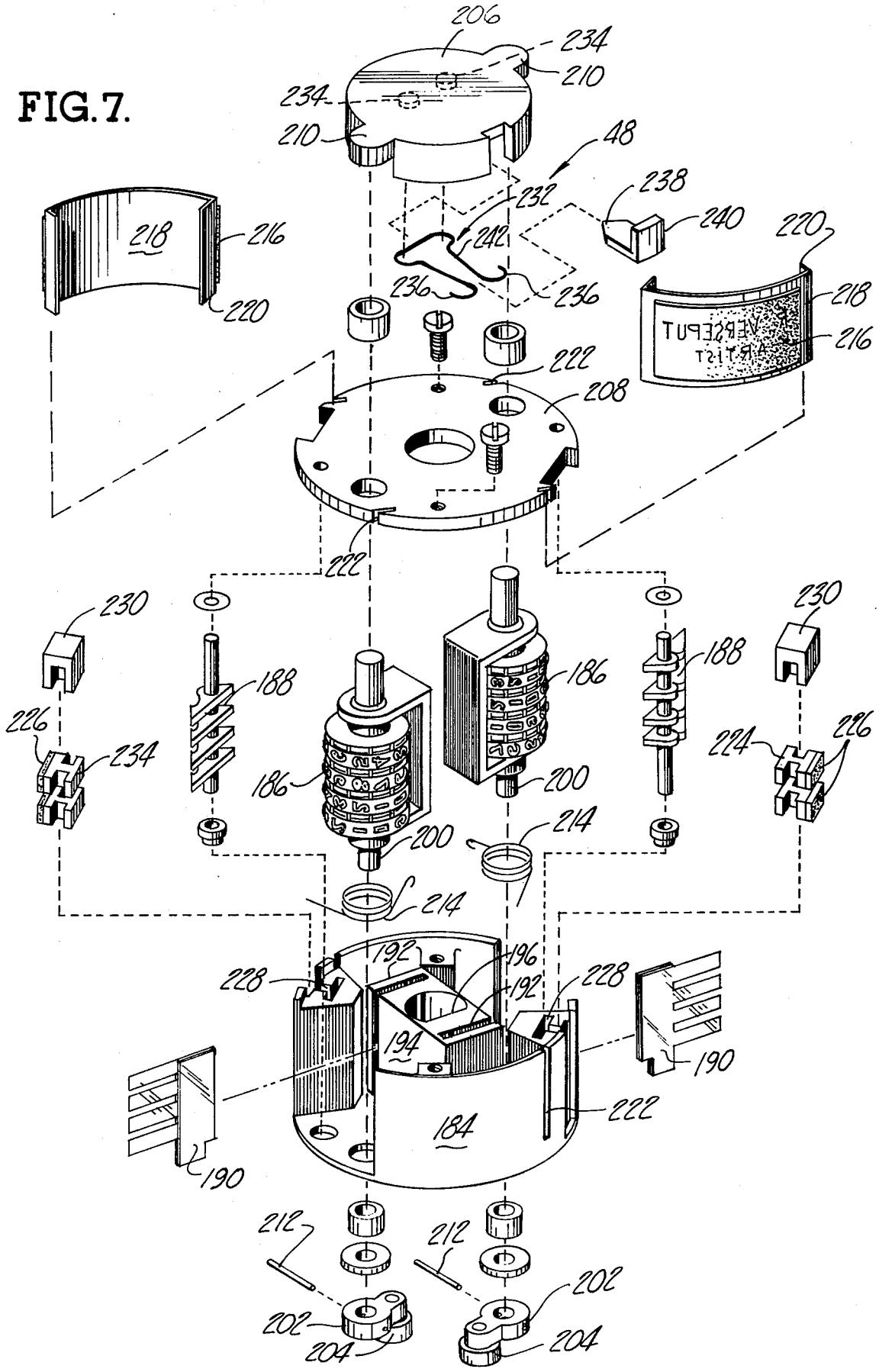
FIG. 7 is an exploded isometric view of the print head of the invention illustrating the internal construction of this assembly.

Print head 48, FIG. 7, is a completely self-contained, operator demountable, unitary assembly providing simple, efficient and convenient access to the data containing printing elements for alteration, change or rearrangement thereof as called for by the customer's business format. A circular, modular, base member 184 of rigid material, e.g. Duraluminum, is machined, drilled or otherwise formed so as to provide a hollow cup-like shell, configured to receive oppositely disposed digital counter mechanisms 186—186, e.g. Veeder Root counters of the four digit variety manufactured by Veeder Root Incorporated, 2401 W. 66 st. Minneapolis, Minnesota. Counters 186 are vertically disposed within member 184, 180° opposed, as seen in FIGS. 7, 8 and 9 with the actuating elements 188 of each counter engaged and detented by corresponding four prong, leaf springs 190—190. Each spring 190 is received in a vertical slot 192 in the central hub 194 of base member 184. Hub 194 is provided with a flat 196 for mating, sliding engagement with a similar flat 198, FIG. 4, on the upstanding end portion of vertical drive shaft 36.

Figure 2:
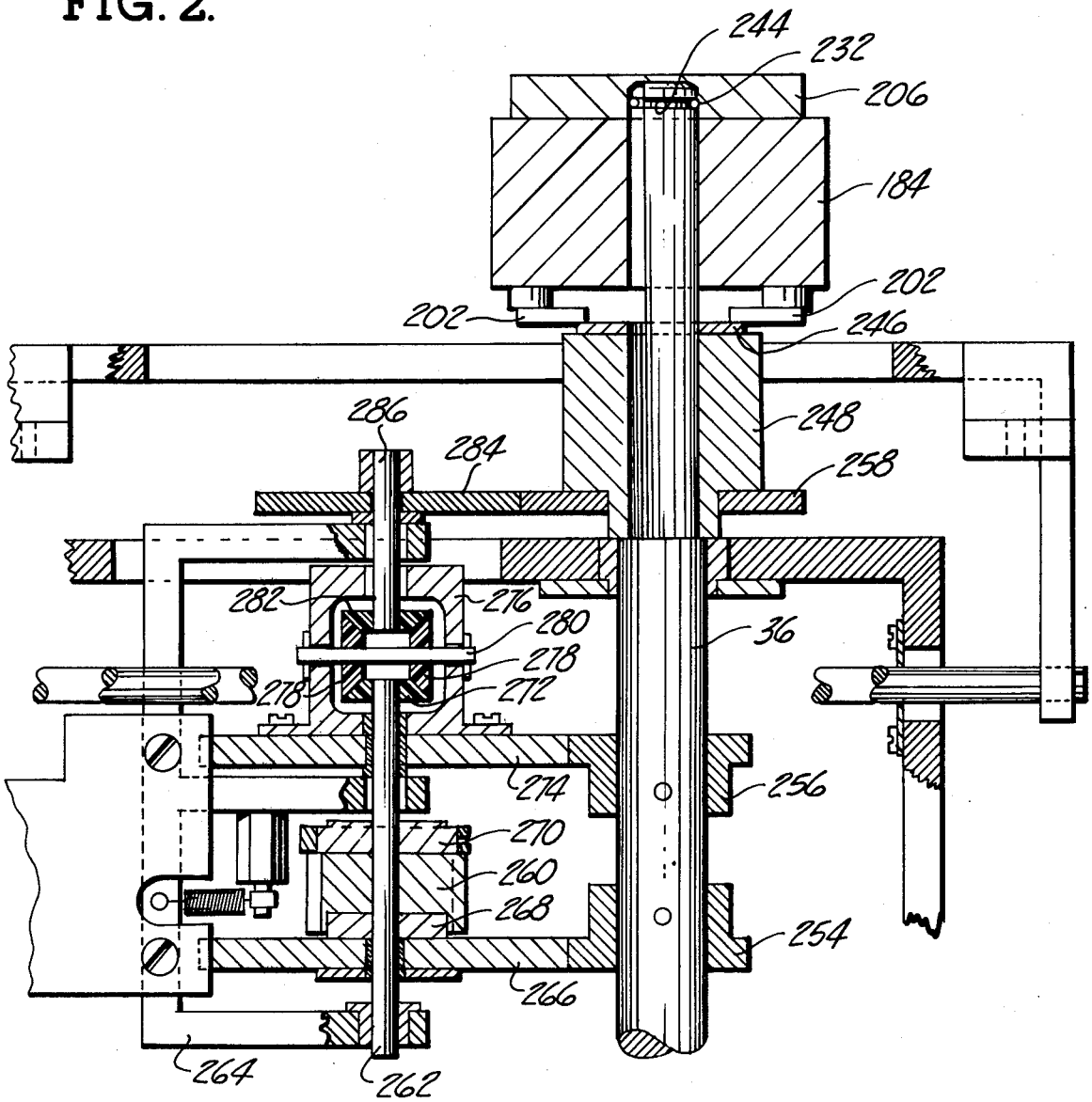
FIG. 2 is an enlarged side elevational view of a portion of the apparatus of FIG. 1 illustrating in more detail the differential gear mechanism used with the invention.

Depending from each counter drive shaft 200 is a stub lever 202, FIGS. 2 and 7, carrying on its inboard, shaft facing end a follower roller 204. The follower rollers and levers are disposed in parallel relationship 180° opposed at all times, FIG. 9. A cap or cover member 206 together with support disc 208 encloses the hollow cup-like base member 184 and provides support bearing means 210 for the upper ends of counter drive shafts 200. The lower end of each counter drive shaft is journaled in base member 184 and is secured to and drives levers 202 by means of cross pins 212. Torsion springs 214 restore the U-frames, within which the count wheels 186 are stacked, to their rest position after each excursion caused by the lobe of the cam. Text and legend information is provided by means of rubber stamp-like members 216 individually secured to respective steel backing members 218, the ends 220 of which are bent back upon themselves at a considerable angle and are receivable in oppositely disposed complementary notches 222 in the base 184 and in the disc 177, respectively. Month and day information is provided by means of demountable inserts 224 faced with rubber or similar material 226 which are received in dovetail fashion in the print head base 184 in T-shaped notches or cutouts 228 provided therefor. Members 230 act as retainers for members 188.

The data or information which is printed by means of the present invention may include bank names, item count, endorsement of a particular bank, batch number of the items, etc. While some of this data is relatively fixed, other of the data is transitory in nature and must be changeable at will. Still other data, e.g. the batch number, must change automatically as the batch count is updated during machine reading-sorting operations. To provide change capability for the relatively fixed or transitory data, the print head 48 is, as before mentioned, structured as a demountable, removable, replaceable unitary assembly.

Cover member 206 for the print head includes a U-shaped spring 232 encircling two oppositely disposed short pins 234 with the confronting arcuately bent ends 236 thereof in engagement with the triangular nose 238 of a slidable latch 240. The straight line portions 242 of spring 232 are receivable within a circular groove 244, FIG. 2, machined in the upper end of vertical drive shaft 36. Depression of the latch 240 forces portions 242 apart sufficiently to release print head 48 for engagement or disengagement with groove 244 in shaft 36. The four digit numbering devices or counters 186 are activated by the input levers 202 and follower rollers 204. Rotation of the levers through approximately 55° advances the display number by one digit.

Motion to induce movement of levers 202 and rollers 204 is provided by rotation of an irregularly shaped drive cam 246, FIGS. 1, 2 and 9, mounted on a rigid cylindrical extension 248 rotatable with its associated drive (to be described later on) at the upper end of drive shaft 36 relative to print head 48 and concentric therewith. This relative motion between cam 246 and print head 48 is accomplished by means of a differential gear train 250 and a wrap spring clutch 252, as shown particularly in FIGS. 1 and 2, now to be described in detail.

Referring first to FIG. 2, gears 254 and 256 are fixed or pinned to main drive shaft 36. Gear 258, extension 248 and cam 246 are free to rotate relative to shaft 36. Gear 258, extension 248 and cam 246 together form one inseparable assembly and therefore rotate together. Clutch sleeve 260, rotatable on shaft 262, journaled top and bottom in an E-shaped frame member 264, is latched (cannot turn) mechanically by means to be described later on herein. Therefore, gear 254 drives gear 266 which is fixed to clutch input hub 268. Output hub 270, shaft 262 and mitre gear 272 are a fixed assembly. Gear 274 and cage 276 are also a fixed assembly. Oppositely disposed mitre gears 278—278 are free to rotate upon cross shaft 280 within the cage 276. Mitre gear 282 and spur gear 284 are fixed to upper shaft 286. Cam and gear assembly 246, 248 and 258, as beforementioned, are free to rotate on shaft 36 relative thereto. Gear 272 remains stationary while gear 256 drives the gear and cage assembly 276.

The gear ratio $$\frac{W256}{W274} = \frac{2}{1} \text{ or}$$

$W\ 256 = 2W_{274}$ $W_L$ = Angular velocity

It is the nature of a differential that $W_{282} + W_{272} = 2W_{274}$. Since $W_{272} = 0$ it follows that $W_{282} = 2W_{274}$. However, $2W_{274}$ is just the original shaft speed, $W_{256}$. A 1/1 gear ratio, therefore, from gear 284 to gear and cam assembly 258-246, results in gear 258 turning at precisely the same velocity as the main drive shaft 36.

When the clutch sleeve 260 is released for 180° rotation, since the ratio $$\frac{W256}{W266} = \frac{2}{1}$$

hub 270, shaft 262 and gear 272 rotate at one half the main shaft 36 speed.

The following analysis shows that:

$W_{272} + W_{282} = 2W_{274} = W_{256}$ $$W_{272} = \frac{W_{256}}{2}$$

$$W_{282} = W_{256} - W_{272} = W_{256} - \frac{W_{256}}{2} = \frac{W_{256}}{2}$$

This shows that gears 282 and 284 now rotate at one half the main shaft velocity (in the opposite direction). The 1/1 ratio $$\frac{W_{284}}{W_{258}}$$

now means that assembly 258-246 rotates at one half the main shaft speed at $$W_{258} = \frac{W_{256}}{2}$$

in the same direction as the main shaft 36.

Print head 48 now has a relatively velocity, $$W_{256} - W_{258} = \frac{W_{256}}{2}$$

with respect to cam 246 for 180°.

In an equivalent mechanism print head 48 rotates at $W_{256}$, holding the cam 246 stationary or $W_{258}=0$ for one half revolution of clutch 252 or gear 266.

Relative velocity between print head 48 and cam 246 produces a phase shift of the print head 48 with respect to cam 246 of 180°. This motion is utilized to actuate the levers 202 depending from the print head, thereby advancing the batch number in each printing counter 186 by one digit for each actuation of the spring clutch 252.

Figure 8A:
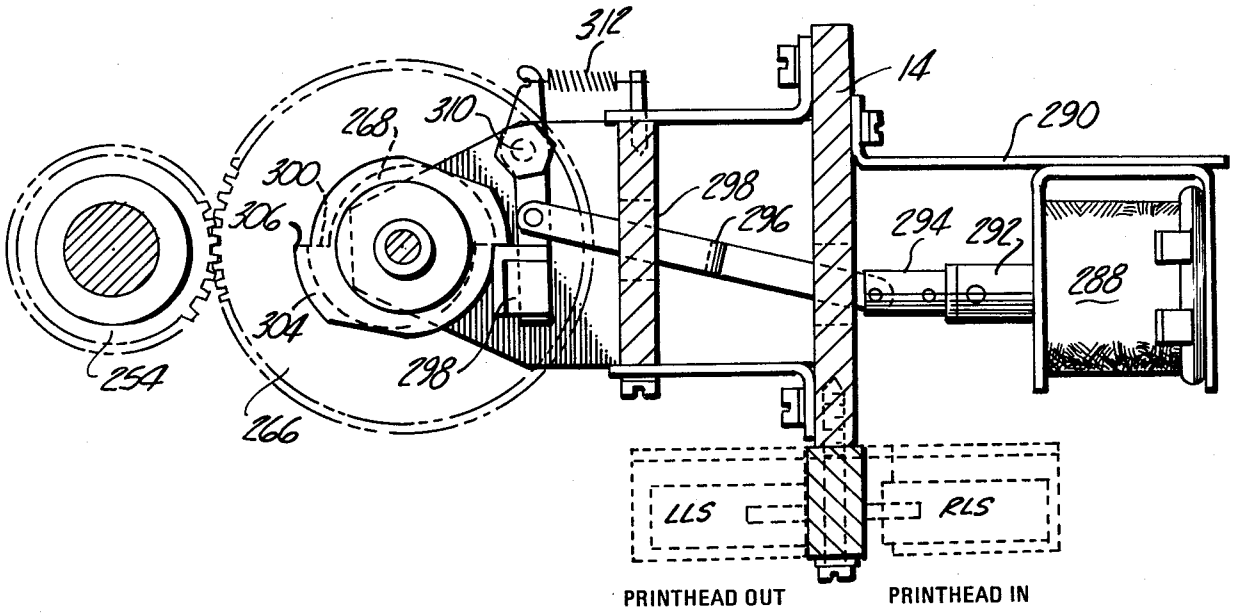
FIG. 8A is a view taken along the line 8A—8A of FIG. 8.
Figure 10:
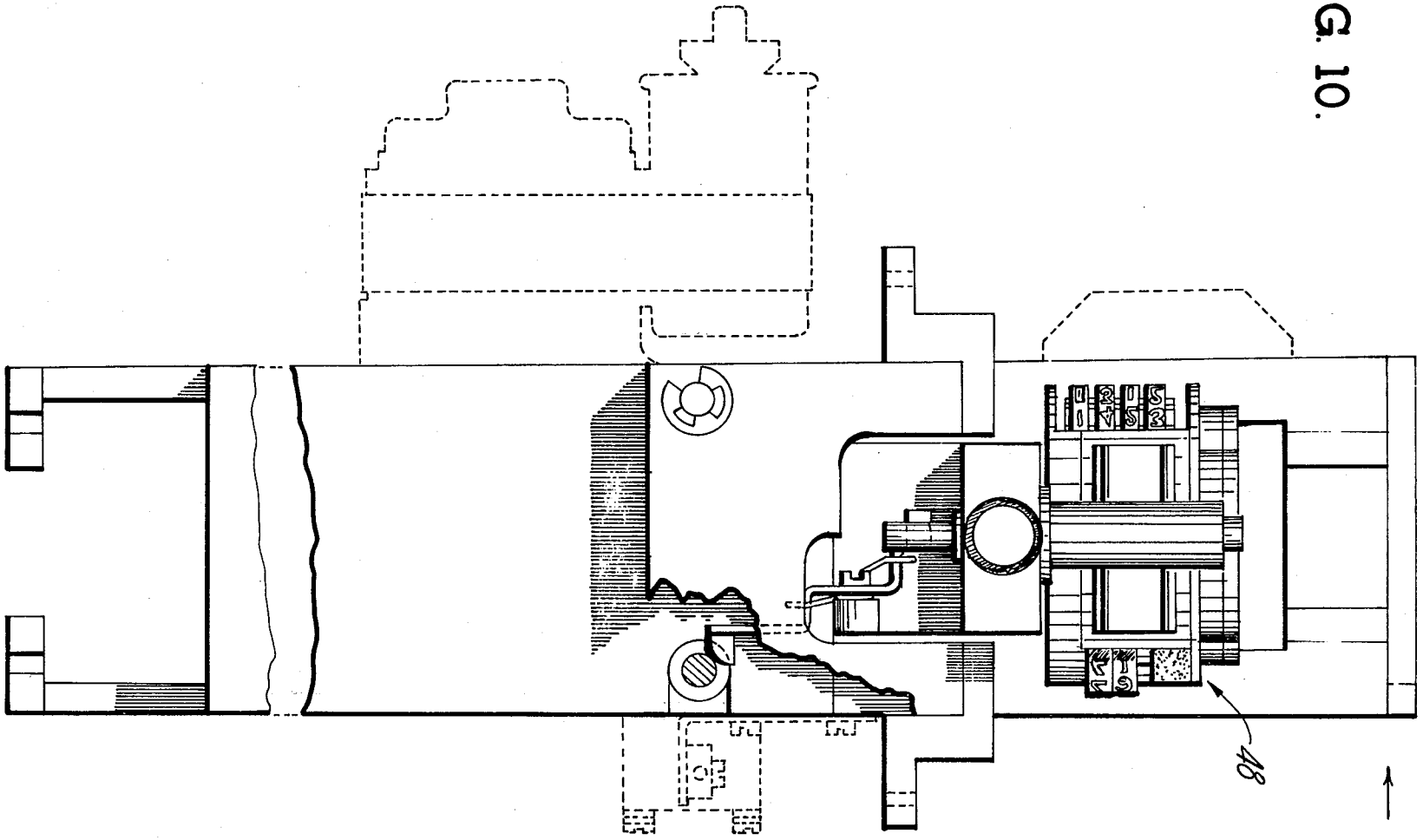
FIG. 10 is an end elevational view of the apparatus of FIG. 1 illustrating the inking shaft control and limit mechanism.

Actuation of wrap spring clutch 252 is controlled by a batch advance solenoid 288, FIGS. 1, 8 and 8A, which is supported on a bracket 290 secured to and extending from the lower frame 14. Solenoid plunger 292 is connected at its forwardly extending end through a link 294 to an irregularly L-shaped drive link 296 which is adapted to project through a clearance aperture 298 in sidewall of member 14 so as to engage a multifaced clutch stop member 298 of rigid, wear-resistant material, for example, nylon. The plastic sleeve (stop collar) 268 of clutch 252 is provided with two 180° offset stop projections 300 engageable with the lower notched portion 302 FIG. 8 of stop member 298. Clamp member 304 also is provided with oppositely disposed stop projections 306 operating in conjunction with a stop notch 308 on stop member 298 to prevent overthrow of the stop member as clutch 252 is clutched and declutched at high speed during operation of the present apparatus. Clutch stop 298 is pivoted at 310 and is biased into engagement with clutch 256 by means of spring 312.

Generally the limitation to the employment of a mechanical numbering device of the type herein described is the speed at which the device is actuated. The present apparatus has a minimum actuation time of 30 milliseconds. With the proposed batch advance mechanism, in order to retain the required minimum actuation time, it is simply necessary to maintain the relative velocity between the print head and the batch advance cam at the same value, (resulting in 30 milliseconds minimum time), regardless of print head absolute velocity. The described gear train is flexible in that by substituting ratios $$\frac{W_{254}}{W_{266}} > \frac{2}{1}$$

as required, the desired relative velocity can be obtained for higher print head velocity should this be necessary or desirable.

Operation

Starting with the endorser in the inactive mode:

(1) An operator initiates the command to endorse documents by pushing an "ENDORSE" button on the main frame assembly (not shown). This command results in the following events:

1.1 The print head is moved to the "ready for print" position.

1.2 A document track shield is automatically raised to expose the print head to the documents.

1.3 A microswitch registers the print head in the "ready" position and signals the processor logic (not shown) that the endorser is ready for printing.

1.4 Each document to be endorsed produces a command signal as it passes through the read station of the reader/sorter to which the endorser is secured. This command causes the platen to impact on the print head to produce an endorsement on each document in a predetermined position with respect to the leading edge of the document.

(2) Batch Advance—Batch advance can only be accomplished when the print head is rotating, as determined by the active status of the "ENDORSE" button. It can be initiated in several ways, under operator control, reader/sorter control or processor control.

2.1 Operator Control—The batch advance solenoid responds to a signal produced when the operator depresses the "Batch Advance" button (on main frame assembly, not shown).

2.2 Reader/Sorter Control—A batch control card placed behind each bath is read and produces a command to pulse the batch advance solenoid once, resulting in an up count of one unit.

2.3 Processor Control—The command signal can also be initiated under program control, each "advance" command resulting in a unit up count of the batch number.

(3) Deactivation of the endorser is accomplished by changing the state of the "ENDORSE" button (switch). The print head is retracted to the "store" position, where a microswitch produces a command signal to stop the main motor, thus ending print head rotation, and to stop the gear motor which moves the print head between "store" and "ready". As the print head is retracted, the document track shield is moved into place to cover the window in the track.

What is claimed is:

1. High speed item printing/endorsing apparatus of modular construction usable for example with item sorting apparatus for endorsing or printing on checks and the like and being demountably removable and replaceable at will comprising:

an input shaft driven at a single speed, an output shaft, drive means for rotating said input shaft and said output shaft, differential gear train shaft speed determining means interconnecting said input shaft with said output shaft settable into one of two states to set a desired one of two speeds of the output shaft to select the printing speed, means coupled to said shaft speed determining means effective when energized to change the output speed of the output shaft to the selected state, print means coupled to said output shaft, cam means driven by said output shaft operably associated with said print means for moving said print means so as to print consecutive data, means responsive to the movement of said cam means to consecutively advance the print means, item moving means coupled to said print means for passing an item to be printed before said print means to produce printed indicia upon said item as the item is moved therepast, and means for energizing said drive means effective to bring said printing means into printing engagement with an item as the item is passed before said print means.

2. The invention in accordance with claim 1 further including print shielding means operably associated with said print means located in the printing path of said print means and being selectably movable between and into one or the other of two positions effective to block printing at one position while permitting printing at the other of said two positions effective to cause said print means to print in a desired location on said item.

3. The invention in accordance with claim 1 including rectilinear support means operably associated with said print means, electric drive means operably coupled to said support means for moving said print means along said support means into and out of the path of movement of said items whereby selected items may receive a printed indicia thereupon.

4. The invention in accordance with claim 3 wherein said electric drive means further includes an eccentric coupling disposed between said electric drive means and said support means effective to control the movement of said print means.

5. The invention in accordance with claim 1 further including back up anvil means and wherein means is provided for loading and unloading said print means relative to said item effective to alter the printing pressure between said print means and said backup anvil means.

6. A high speed item printing/endorsing apparatus usable, for example, with item sorting apparatus for endorsing or printing on checks and the like, comprising:

an input shaft driven at a single speed, an output shaft, drive means for rotating said input shaft and said output shaft, differential gear train shaft speed determining means interconnecting said input shaft with said output shaft settable into one of two states to set a desired one of two speeds of the output shaft to select the printing speed, means coupled to said speed determining means for changing the state of said speed determining means effective when energized to change the output speed of the output shaft to the set speed, demountable print means including both fixed and variable data coupled to said output shaft, cam means driven by said output shaft, said print means capable of printing consecutive data including means responsive to the movement of said cam means effective when said cam is moved to advance said print means to print consecutive data, rotatable backup anvil means adjacent to said print means including means for sychronizing the rotative movement of said anvil means with said print means effective to produce printed indicia upon said item at high speed without blurring as said item is moved therepast, and additional drive means effective to move said printing means into printing engagement with an item as the item is passed before said print means.

7. The invention in accordance with claim 6 wherein there is provided demountable, renewable, inking means for said print means including shield means surrounding said inking means leaving a major portion of said inking means exposed, means mounting said inking means adjacent to said print means, tensioning and loading means operatively coupled to said inking means effective to preload said inking means relative to said print means.

8. The invention in accordance with claim 7 including means operably coupled to said support means and said inking means effective to move said inking means toward and away from said printing means thus loading and unloading the inking means relative to the printing means effective to prevent the inking means from bleeding onto the printing means.

9. The invention in accordance with claim 6 wherein said print means further includes a horizontally deflectable spring biased member, a flat shaft portion on said output shaft receives and engages said print means thereon, said print means further includes a demountable, rotatable, circular member including vertically oriented oppositely disposed parallel slots, arcuately shaped print members carrying fixed printing indicia receivable in said slots so as to present the print bearing surface thereof to said anvil as said print means is moved, a pair of enlarged T-shaped slots disposed in opposite side edges of said print means, other fixed information bearing members in the form of demountable printing elements having resilient T-shaped inserts secured in said slots and a cap member press fit into each said slot to retain said information bearing members therein.

10. The invention in accordance with claim 6 further including limit switch means operably associated with said additional drive means to control said additional drive means so as to move said printing means from an operative to an inoperative position by energizing and deenergizing said additional drive means.

* * * * *